United States Patent [19]

Mizukami

[11] Patent Number: 4,531,906

[45] Date of Patent: Jul. 30, 1985

[54] LIGHTER CASE HAVING WINDSHIELD

[76] Inventor: Yukihiro Mizukami, 17-12, Ikegami 5-chome, Ohta-ku, Tokyo, Japan

[21] Appl. No.: 640,763

[22] Filed: Aug. 14, 1984

[30] Foreign Application Priority Data

Aug. 19, 1983 [JP] Japan ..... 58-128059[U]
Jan. 17, 1984 [KR] Rep. of Korea ..... 84-349[U]

[51] Int. Cl.[3] ..... F23Q 25/00
[52] U.S. Cl. ..... 431/146; 431/310
[58] Field of Search ..... 431/142, 146, 350, 310, 431/151

[56] References Cited

U.S. PATENT DOCUMENTS 1,800,334 4/1931 Aronson ..... 431/310
4,371,331 2/1983 Lee ..... 431/151

FOREIGN PATENT DOCUMENTS 87239 11/1920 Switzerland ..... 431/146

*Primary Examiner*—Carroll B. Dority, Jr.
*Attorney, Agent, or Firm*—Wolf, Greenfield & Sacks

[57] ABSTRACT

A lighter case having a windshield is provided. The lighter case includes a hollow case member adapted to receive therein a lighter through a top opening thereof and a windshield member adapted to be received in the case member and to receive therein at least a part of the lighter through an open side portion thereof. The case member includes a side opening for facilitating access to the windshield therethrough of the finger of a user and the windshield member includes an open bottom, so that the windshield can be slidably displaced in the longitudinal direction with respect to the case member.

3 Claims, 6 Drawing Figures

LIGHTER CASE HAVING WINDSHIELD

BACKGROUND OF THE INVENTION

The present invention relates generally to a lighter case for use with a lighter, particularly one of a disposable type, and more specifically relates to a lighter case having a windshield.

A conventional lighter of disposable type is not provided with a windshield. Therefore, when it is used outdoors, in particular in an area where the wind blows strongly, the ignition properties thereof are greatly reduced.

It will easily be understood that the defect possessed in a conventional disposable lighter can be eliminated by providing it with a windshield. However, additional provision of a windshield to a disposable lighter will essentially increase the cost of production thereof and will also make the size thereof larger, thus greatly reducing the most advantageous feature of a disposable lighter which is its inexpensiveness and portability.

Accordingly, the object of the present invention is directed to the provision of a lighter case having a windshield to be used with a disposable lighter which is sold independently on the market.

SUMMARY OF THE INVENTION

The present invention provides a lighter case having a windshield comprising a hollow case member adapted to receive therein a lighter and including a top opening for inserting and removing the lighter therethrough and at least one side opening, and a windshield member adapted to be received in the case member and to receive therein at least a part of the lighter, the windshield member including an open side portion and an open bottom, and a top portion which is at least partly opened, and the windshield member being mounted in the case member for slidable movement in the longitudinal direction with respect to the case member.

In one embodiment of the ivention, the top portion includes an opening which is in alignment with the flame ejection port of the lighter.

In one embodiment of the invention, the inside wall of the case member includes a groove for guiding the windshield member in the longitudinal direction.

DETAILED DESCRIPTION OF THE INVENTION

The present invention will now be described in detail with reference to the accompanying drawings.

Figure 1:
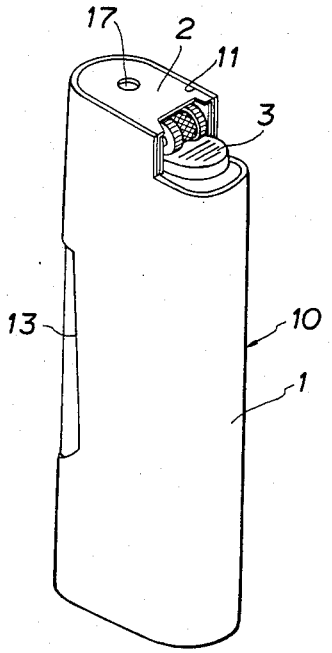
FIG. 1 is a perspective view of a lighter case of the invention, which receives a lighter therein, illustrating a windshield in its lowermost position.
Figure 6:
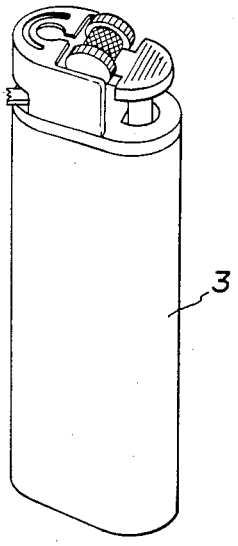
FIG. 6 is a perspective view of a conventional, disposable lighter.

As shown in FIG. 1, a lighter case 10 of the present invention includes a hollow case member 1 adapted to receive therein a conventional, disposable lighter 3 as shown in FIG. 6, and a windshield member 2 received within the hollow case member 1 for slidable movement and adapted to receive at least a part of the lighter.

The case member 1 includes a top opening 11 for permitting insertion and removal of the lighter 3 therethrough and a side opening 13 allowing access therethrough for the finger of a user to the windshield member 2 when he intends to slidably displace the windshield member within the case member in a longitudinal direction by pushing it up or down.

Figure 4:
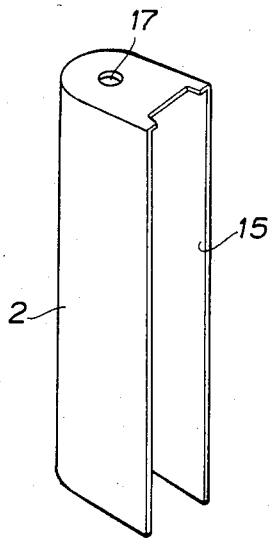
FIG. 4 is a perspective view of the windshield member.

The windshield member 2, as shown in FIG. 4, includes an opening 15 in its side portion for receiving the lighter therein and an opening 17 in its top wall allowing the flame of the ligher to pass therethrough. The windshield member also includes an open bottom for permitting slidable movement thereof relative to the lighter. It is noted that the top wall may be fully opened instead of the opening 17 being formed therein. However, the anti-wind properties of the lighter case can more effectively be exerted with the construction shown in the drawings.

Figure 2:
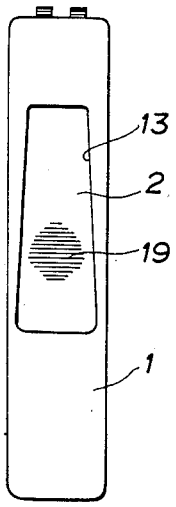
FIG. 2 is a side view of the lighter case shown in FIG. 1 as viewed from the side of a side opening thereof.

As shown in FIG. 2, the side wall of the windshield member 2 located in the side opening 13 of the case member 1 can be provided with an anti-sliding portion 19 to facilitate manipulation by the user to vertically displace the windshield member in the upward or downward direction.

It is possible to guide the slidable movement of the windshield member 2 without providing any guide means. This is achieved by appropriately conforming the configuration and the size of the case member 1 to those of disposable lighters already on the market such that the windshield member can be slidably moved between the inside surface of the case member 1 and the outside surface of the lighter in substantially tightly fitting relationship.

Figure 5:
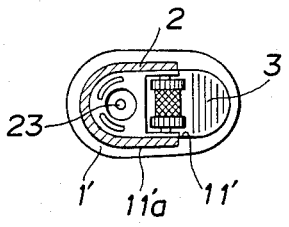
FIG. 5 is a top plan view, partly in section, of a lighter case of another embodiment of the invention.

It is also possible to provide a guide means within the case member which permits the windshield member to be reliably held in the case member. As shown in FIG. 5 which illustrates a plan view of another embodiment of the lighter case of the invention, the interior of a case 1' has a portion 11' of an elliptical cross section which substantially conforms to the outside shape of the lighter 3 and has a groove **11'*a* having a substantially U-shaped cross section which is enlarged in radially outward direction with respect to the portion of elliptical cross section 11'. As shown in the drawing, the crosss sectional configuration of the groove 11'*a* substantially conforms to the outside shape of the windshield member 2 (in FIG. 5, the top portion thereof is cut out). Thus, the windshield member can be reliably retained in the case member 1'** independently of the lighter.

The operation of the lighter case of the invention will be explained hereinafter.

In FIGS. 1 and 2, the lighter case 10 of the invention receiving therein a conventional disposable lighter 3 is shown. In FIG. 1, the windshield member is shown in its lowermost position with its opening 17 aligned with a nozzle port 23 (FIG. 5) of the lighter 3. Thus, the lighter can be used in the usual way.

Figure 3:
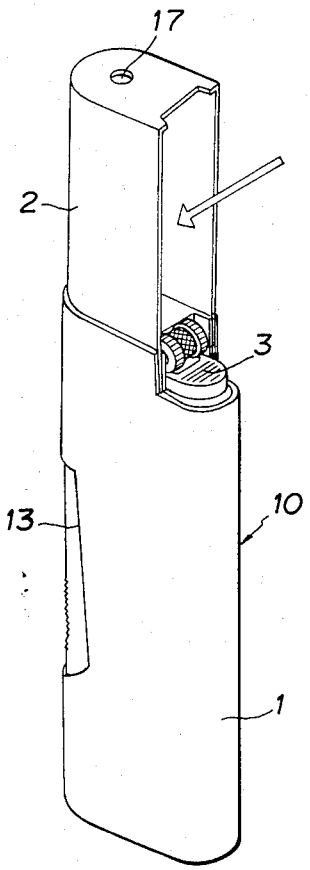
FIG. 3 is a perspective view of the lighter case shown in FIG. 1 illustrating the windshield member in its raised position.

Turning now to FIG. 3, the windshield member 2 is shown in its raised position. Locating the windshield member in the raised position can easily be achieved by merely pushing it up with the finger of a user through the side opening 13. By actuating the lighter with the windshield member in the raised position, it will easily be lit because the ignition portion of the lighter is protected from the wind by the windshield member. Once the lighter is lit, a cigarette is inserted into the ignition portion of the lighter covered by the windshield in the direction shown in FIG. 3 to thereby be lit.

As described hereinbefore, a lighter case of the invention has a windshield member which is slidably mounted within the case member. Therefore, a lighter received in the lighter case of the invention can be used indoors in the usual way by locating the windshield member in its lowermost position, while it can also be used outdoors with a wind blowing strongly with the windshield disposed in its raised position merely by pushing the windshield upwardly.

What is claimed is:

1. A lighter case comprising a hollow case member adapted to receive therein a lighter and including a top opening for inserting and removing said lighter therethrough and at least one side opening; and a windshield member adapted to be received in said case member and to receive therein at least a part of said lighter, said windshield member including an open side portion and an open bottom, said windshield member including a top portion which is at least partly opened, and said windshield member being mounted in said case member for slidable movement in the longitudinal direction with respect to said case member.

2. A lighter case according to claim 1, wherein said top portion includes an opening which is in alignment with the flame ejection port of said lighter.

3. A lighter case according to claim 1, wherein the inside wall of said case member includes a groove for guiding said windshield member in the longitudinal direction.

* * * * *